US010029876B2

(12) United States Patent
Hou

(10) Patent No.: US 10,029,876 B2
(45) Date of Patent: Jul. 24, 2018

(54) INTERLINER METHOD AND APPARATUS

(71) Applicant: Web Industries, Inc., Marlborough, MA (US)

(72) Inventor: Grand Hou, Norcross, GA (US)

(73) Assignee: Web Industries, Inc., Marlborough, MA (US)

( * ) Notice: Subject to any disclaimer, the term of this patent is extended or adjusted under 35 U.S.C. 154(b) by 0 days.

(21) Appl. No.: 13/687,022

(22) Filed: Nov. 28, 2012

(65) Prior Publication Data

US 2013/0284845 A1 Oct. 31, 2013

Related U.S. Application Data

(60) Provisional application No. 61/639,287, filed on Apr. 27, 2012.

(51) Int. Cl.

*B65H 23/04* (2006.01)
*B65H 23/08* (2006.01)
*B65H 39/16* (2006.01)

(52) U.S. Cl.

CPC ..... *B65H 23/04* (2013.01); *B65H 23/08* (2013.01); *B65H 39/16* (2013.01); *B65H 2301/414324* (2013.01)

(58) Field of Classification Search

CPC ..... B65H 2220/01; B65H 2220/02; B65H 23/04; B65H 23/08; B65H 39/16; B65H 2301/414324

USPC ..... 242/525, 525.1, 525.5, 530, 530.1, 242/530.2–530.4, 534, 534.1, 413, 413.1, 242/418, 418.1, 419, 419.1, 420, 420.5, 242/420.6, 421.5

See application file for complete search history.

(56) References Cited

U.S. PATENT DOCUMENTS

| | | | | | |
|---|---|---|---|---|---|
| 1,475,855 | A | * | 11/1923 | Murdock | 242/419.1 |
| 1,904,420 | A | * | 4/1933 | Dickhaut | 242/419.1 |
| 1,962,029 | A | * | 6/1934 | Edward et al. | 242/418.1 |
| 1,978,715 | A | * | 10/1934 | Meisel | 101/228 |
| 3,276,648 | A | * | 10/1966 | Lewis, Jr. et al. | 226/33 |
| 3,540,674 | A | * | 11/1970 | Okamura | 242/147 R |
| 3,563,485 | A | * | 2/1971 | Phillips | 242/413.5 |
| 3,591,101 | A | * | 7/1971 | Gallet et al. | 242/415.1 |
| 3,650,490 | A | * | 3/1972 | Saunders | 242/417.3 |
| 3,670,975 | A | * | 6/1972 | Tomimatsu | 242/413.1 |
| 3,731,890 | A | * | 5/1973 | Ruoff | G11B 15/56 242/334.6 |

(Continued)

FOREIGN PATENT DOCUMENTS

| | | |
|---|---|---|
| CN | 1386693 A | 12/2002 |
| JP | 53 147168 A | 12/1978 |

(Continued)

OTHER PUBLICATIONS

Supplementary Search Report of European Patent Office dated Sep. 30, 2016.

(Continued)

*Primary Examiner* — Michael E Gallion

(74) *Attorney, Agent, or Firm* — Edward K Welch, II; IP&L Solutions

(57) ABSTRACT

An improved method and apparatus for the interleaf winding of materials, especially adhesive, sticky, or tacky materials, which method involves maintaining a tension in the liner material at the point where it is mated with the material being wound.

25 Claims, 10 Drawing Sheets

(56) References Cited

U.S. PATENT DOCUMENTS 3,794,255 A * 2/1974 Harmon ..... B65H 19/26 242/527.4
3,811,637 A * 5/1974 Abler ..... B65H 23/063 242/413.4
3,822,838 A * 7/1974 Butler, Jr. ..... B65H 23/063 242/417.2
3,827,358 A * 8/1974 Budai ..... B41F 13/04 101/228
3,831,873 A * 8/1974 Bense ..... B65H 51/20 242/364.12
3,952,961 A * 4/1976 Antepenko ..... B65B 13/18 242/421.8
3,982,710 A * 9/1976 Teumer ..... B65H 23/1955 242/412.2
4,131,501 A * 12/1978 Bottcher ..... B65H 19/1836 156/157
4,159,808 A * 7/1979 Meihofer ..... B65H 23/1955 242/413.1
4,173,313 A * 11/1979 Rogers ..... B21C 47/006 242/525.4
4,216,676 A * 8/1980 Bugnone ..... G01M 13/00 101/479
4,365,767 A * 12/1982 Benthimere ..... B65H 18/103 242/530.2
4,484,713 A * 11/1984 Tschentscher ..... B65H 54/28 242/416
4,488,925 A 12/1984 Craig et al.
4,519,285 A * 5/1985 Dontscheff ..... B26D 1/185 83/176
4,635,867 A * 1/1987 Kytonen ..... B65H 18/20 242/527.2
4,708,301 A * 11/1987 Kataoka ..... B65H 20/16 226/44
4,752,043 A * 6/1988 Heinzer ..... B65H 55/04 242/159
4,795,510 A * 1/1989 Wittrock et al. ..... 156/64
5,050,812 A * 9/1991 Mueller ..... 242/418.1
5,176,334 A * 1/1993 Dreschau et al. ..... 242/413.3
5,470,005 A * 11/1995 King et al. ..... 226/1
5,516,059 A 5/1996 Omokawa et al.
5,657,941 A * 8/1997 Simons et al. ..... 242/420.6
5,718,394 A * 2/1998 Simons et al. ..... 242/420.6
5,941,473 A * 8/1999 Kawano et al. ..... 242/413.1
6,079,654 A * 6/2000 Sasou et al. ..... 242/348.1
6,082,657 A * 7/2000 Chen et al. ..... 242/420.6
6,145,777 A * 11/2000 Zach et al. ..... 242/533
6,164,583 A * 12/2000 Spatafora ..... 242/420.6
6,230,616 B1 * 5/2001 Steuer ..... 101/23
6,340,130 B2 * 1/2002 Wild et al. ..... 242/420.6
6,364,234 B1 * 4/2002 Langiano et al. ..... 242/334.3
6,402,077 B1 6/2002 Vargo et al.
6,536,702 B1 3/2003 Vargo et al.
6,676,062 B1 * 1/2004 Herhaus ..... 242/417
7,101,504 B2 * 9/2006 Suzuki ..... 264/481
7,438,251 B2 * 10/2008 St. Germain et al. ..... 242/417.3
7,748,425 B2 7/2010 Tingley
8,012,291 B2 9/2011 Kisch et al.
8,063,783 B2 * 11/2011 Miyashita et al. ..... 340/572.1
8,720,812 B2 * 5/2014 Liu et al. ..... 242/412.2
2001/0013561 A1 * 8/2001 Wild et al. ..... 242/418.1
2001/0023906 A1 * 9/2001 Saito et al. ..... 242/414.1
2004/0245363 A1 * 12/2004 Vaeth ..... 242/417
2007/0138331 A1 * 6/2007 Bett et al. ..... 242/418.1
2009/0242685 A1 * 10/2009 Scholten et al. ..... 242/538
2009/0289141 A1 * 11/2009 Griesshammer et al. . 242/484.6
2010/0206977 A1 * 8/2010 Kitada et al. ..... 242/525
2010/0215887 A1 8/2010 Kawabe
2010/0243788 A1 * 9/2010 Oku ..... 242/525
2010/0258248 A1 * 10/2010 Perecman ..... 156/349
2013/0068874 A1 * 3/2013 Schwamberger et al. . 242/526.1
2013/0119182 A1 * 5/2013 Higeta ..... 242/538.1
2013/0240656 A1 * 9/2013 Merz et al. ..... 242/410
2013/0299623 A1 * 11/2013 Dollevoet et al. ..... 242/534

FOREIGN PATENT DOCUMENTS

JP 61178359 A 8/1986
JP H03 184273 A 8/1991
JP H04 351530 A 12/1992
JP 05-008321 A 1/1993
JP 05-084850 A 4/1993
JP 05-270727 A 10/1993
JP 09-240893 A 9/1997
JP 10-053366 A 2/1998
JP 2000016653 A 1/2000
JP 2002338133 A 11/2002
JP 2003 118901 A 4/2003
JP 200490256 A 3/2004
JP 2008149708 A 7/2008
KR 20090039087 A 4/2009

OTHER PUBLICATIONS

WO2013/163638 International Search Report and Written Opinion (Equivalent PCT Application).
CN 2013 800342464 Search Report (Equivalent CN Application).
EP2841372A Third Party Submission (EP Equivalent).
EP2841372A Applicant Response to Third Party Submission (EP Equivalent).

* cited by examiner

INTERLINER METHOD AND APPARATUS

The present application claims the benefit of U.S. Provisional Patent Application No. 61/639,297 filed Apr. 27, 2012, the contents of which are hereby incorporated herein by reference in their entirety.

FIELD OF THE INVENTION

The present application is directed to an improved method and apparatus for interleafing a liner material between continuous winds of various materials whose nature is such that it is undesirable to have one winding directly applied to or overlay another. Specifically, the teachings of the present application allow for high speed winding of various materials, especially those in film or strip form, around a spool, bobbin or like core element while simultaneously interleafing a continuous film or strip of a liner material between successive windings or layers of the first material. The present apparatus and method is especially suited for use in winding of adhesive and/or flowable materials, especially prepreg materials, most especially slit tape.

BACKGROUND

Numerous methods and apparatus are known, widely available and commercially practiced for winding various materials about a spool, bobbin, or like core element. Such windings typically take the form of large rolls, e.g., as with carpeting and newsprint; as pancake coils, e.g., as with bow ribbon and reel-to-reel recording tape; or a helical or transverse winding, e.g., as with binding ribbon, cord, and prepreg slit tape. In the latter the winding is most often about spool or bobbin whose length is many times the width of the material being wound and the feed of material, as the winding progresses, moves from one end of the spindle to the other, back and forth, gradually building the layers of wound material about the spool or bobbin.

The aforementioned winding processes are typically performed by laying one layer atop another. However, not all materials are suitable for or amenable to winding of one layer atop another. Specifically, materials that are sticky, tacky, or adherent or are comprised of a flowable material, especially one that flows slowly over time, most especially at ambient and higher temperatures, are not amenable to being successively wound, one layer atop another as they may bind to one another or may manifest a tendency to morph into one another. Winding without a support also poses problems where the material being wound has poor physical integrity or strength and/or high flexural or elongation properties since too much tension in a winding process or, more so, in the unwinding process can cause a break in the material being wound or unwound, respectively.

To address these issues, it is common to employ a liner material which is inserted or interleafed between successive windings of the material being wound. The composition and physical properties of these liner materials are most often chosen to meet the needs of the specific winding process. For example, when one is winding a sticky, tacky and/or adherent material, it is most common to employ a liner that is or serves as a release liner whose composition is of a non-stick material and/or whose surface is treated with a release agent or coated with a release coating: the release properties of the liner, treatment or coating preventing the adherent from binding to the liner material itself. Where the material being wound is in need of structural support or strength, the liner may be a woven or non-woven fabric or fabric-like material or a high strength polymer film.

Apparatus for interleafing the liner materials are also well known, widely available and commercially used. Generally speaking, they integrate an unwinding station having a freely rotating axel and a plurality of feed and alignment guide elements into a standard winding apparatus. The axel is adapted to hold a pancake coil or spool of the liner material and the feed and alignment guide elements are configured to direct the liner material from the unwinding station to the winding station to be mated with the material being wound while concurrently aligning the strip of the liner material with the material being wound so that the two layers overlay one another at a point prior to that at which they make contact with the spool or winding. As noted, typically the axel upon which the spool of liner is mounted is freely rotating, i.e., its rotation is caused by the pull or draw of the liner material as it is wound with the first material, and is not motor driven. Given the speed with which certain of these winding apparatus operate, it is also common for the unwinding station to integrate or have associated therewith, especially with the axel, a means, element or component which places or creates a slight resistance in or to the rotation of the axel and/or the spool of liner material mounted thereon. The resistance is very low such that a minimum tension from the winding process enables the unwinding of the liner material but sufficient to prevent the axel from continuing to freely rotate with the concomitant unwinding of the liner material should the winding process be stopped suddenly.

Notwithstanding the foregoing, as much benefit as the resistance means provides in preventing the unrestrained unwinding in the case where the apparatus is suddenly stopped, it creates a new concern in the unwinding of liner itself. Specifically, as the spool of wound material grows and the spool of liner shrinks the speed of rotation of the axel holding the liner material becomes faster and faster. Here the resistance has the adverse effect of adding more and more tension to the liner material as the demand for liner is much more urgent as the supply dwindles on the axel. At a minimum this results in a stretching and/or twisting of the liner material, which, in turn leads to a narrowing of the width of the line material and/or greater difficulty in proper alignment of the liner material with the material being wound. At worst, it can lead to a break in the liner material necessitating the shut down of the process to re-feed the liner to the winding element. Slowing the overall winding process may help alleviate some of this concern, but any slow down in the winding process has an adverse economic effect on the efficiency of the overall production process.

Furthermore, while certain interleafing winding processes, e.g., those wherein the material being wound is structurally sound, stable, non-adhesive, non-tacky and non-flowing, may enable the use of liners whose width is the same as that of the material being wound, most interleafing or interlining processes, as they are also referred, employ, and must employ, a liner that is somewhat wider than the material being wound. This is especially true for those winding processes wherein the material being wound manifests a sticky, tacky or adhesive property material or involves a flowable material or a material that will or may manifest creep during winding, storage, handling and transportation, or any time prior to use and most especially those also involving a helical or transverse winding process. In the case of adherent, sticky or tacky materials, the wider tapes are necessary to address the lack of accuracy in being able to directly align the edges of the material being wound with the edges of the liner material, especially in higher speed winding processes, as well as those situations wherein the liner is narrowed owing to increased tension in the liner as it is being unwound. In the case of those wound materials that are subject to flow or creep, a wider liner prevents the materials from flowing past the edges of the liner to bind and/or morph with underlying layers and or adjacent windings.

Regardless, whether the process involves one or the other or both of the foregoing issues, the ultimate effect is an adverse impact on processing speed and utility of the final product. Specifically, if one must adjust the winding speed to address the deficiencies in the overall winding process or eliminate or reduce out-of-specification products, the overall efficiency and costs are adversely impacted. Similarly, if the material being wound binds or morphs with underlying layers or adjacent windings, one has a strong potential for significant irregularities in the unwinding process or a loss of the whole of the winding itself. For example, if one layer or winding binds to or morphs with another, then as that layer is being unwound, it will tend to tear the winding to which it is bound or morphed or simply fail to unwind. In the former, the whole or a significant part of that wound material is useless. In the latter, the inability to unwind may lead to a total shut down of the manufacturing process in which the wound material is being used. Of course not all situations will lead to as catastrophic scenarios as presented in the foregoing; however, even a seemingly minor snag or catch caused by one winding being slightly bound or tacked to another may alter the dimensions or create a defect in the material being unwound, adversely affect the physical properties of the ultimate end products being made from the wound material or trigger sensors that monitor changes in the tension of the material as it is unwound which, in turn, may lead to a shut down the process to allow for an inspection of the material to ensure its integrity and in-specification characteristics.

While many improvements and advancements in winding and unwinding processes have been made, there is still a need for an interleafing process which provides for a constant or substantially constant tension in the liner material as it is being wound, irrespective of the line speed.

Additionally, there is a need for an interleafing process which allows for even higher speed windings with greater accuracy in the alignment of the liner to the material being wound, especially in the winding of adhesive, sticky, tacky, and/or flowable materials.

Finally, there is a need for a high speed interleafing winding process which allows for liner widths that are the same as or essentially the same as that of the material being wound, even when winding flowable and/or adherent, tacky or sticky materials.

SUMMARY OF THE INVENTION

According to the present teachings there is provided an improved method for the interleaf winding of materials wherein the improvement comprises maintaining a substantially constant, if not constant, tension on the liner material at the point at which the liner material is mated with the material being wound (the "mating point") throughout the winding process. Specifically, there is provided an improved interleaf winding method wherein the improvement involves detecting differences in the tension of the liner material and/or the rate at which the interleaf material is being fed or drawn from the liner supply and the rate at which it is being taken up in the winding process and in response thereto, adjusting, at least on a temporary basis, the rate at which the liner material is fed or drawn from the liner supply so as to maintain a tension on the liner material at the mating point. Differences in the rates may be determined by switches, sensors and the like which detect changes in the length of liner from the liner supply to the mating point or by sensors which detect changes in the tension of the liner material itself. Advancement or acceleration in the rate at which the liner material is fed or drawn from the liner supply may be passive, e.g., the lessening or removal of any hindrance or rate controller associated with the liner supply, or direct, e.g., motor driven advancement or acceleration in the feed of liner from the liner supply. In a preferred embodiment, the source of the liner material is a spool of wound liner and the tension of the liner material is monitored by a sensor or trigger mechanism in the liner pathway which, upon detecting changes in the length and/or tension of the liner between the source and the winding spool, allows for or causes an advancement or temporary acceleration in the rotation of the spool of liner material wherein said advancement or temporary acceleration is motor driven. In this latter instance, the liner pathway includes a tensioning device intermediate the liner supply and the winding spool whereby any slack in the liner caused by the advancement or temporary acceleration is concurrently taken up whereby the tension in the liner intermediate the tensioning device and the winding spool is maintained.

According to a second aspect of the present application there is provided an improved method for the interleaf winding of materials which improvement comprises employing a closed loop winding process and, optionally, double grooved roller elements to align and direct the material being wound with the liner while maintaining a substantially constant, if not constant, tension in the liner material at the mating point throughout the winding operation. When the double grooved rollers are employed, the process allows for higher winding speeds with greater accuracy, as evidenced by lesser out-of-specification products, as compared to products produced on the same system which does not employ the double grooved rollers: out-of-specification products being evidenced by, e.g., misalignment of the liner and wound material or bumps, ridges, crimps, etc., in one of the liner or wound material.

According to a third aspect of the present application there is provided an improved method for the interleaf winding of materials which improvement manifests in higher winding speeds with greater accuracy and reduced liner needs wherein the improvement comprises maintaining a substantially constant, if not constant, tension of the liner material at the mating point throughout the winding operation, employing double grooved roller elements to align and direct the material being wound with the liner, and employing a liner material that is of the same or substantially same width as the material being wound.

The present invention is also directed to an improved apparatus for an interleaf winding process wherein the improvement comprises the presence of elements which are adapted and aligned to maintain a constant tension in the liner material at the mating point throughout the winding process. Specifically, in an apparatus adapted for interleaf winding comprising a source of a material to be wound, a source of liner material and a winding element there is provided a detection and adjustment system associated with the liner pathway and intermediate the liner source and the mating point which detection and adjustment system detects differences in the tension of the liner and/or the rate at which the liner material is being fed or drawn from the liner supply and the rate at which it is being taken up in the winding process and in response thereto adjusts, at least on a temporary basis, the rate at which the liner material is fed or drawn from the liner supply. The detection and adjustment system comprises, as the detector component, (i) switches or sensors or the like which detect changes in the length of liner from the supply to the mating point or (ii) sensors which detect changes in the tension of the liner material itself and the adjustment component comprises (i) a motor associated with the feed of the liner from the liner supply, which motor is capable of accelerating, at least on a temporary basis, the rate at which the liner is fed from the liner supply or (ii) a controller which lessens or removes the impact of any device employed to hinder or add resistance to the rate at which the liner is able to be fed or drawn from the liner supply. In a preferred embodiment, the source of the liner material is a spool of wound liner and the tension of the liner material is monitored by a sensor or trigger mechanism in the liner pathway, inclusive of the liner unwind station itself, which, upon detecting changes in the length and/or tension of the liner, allows for or causes an advancement or temporary acceleration in the rotation of the spool of liner material wherein said advancement or temporary acceleration is motor driven. Most preferably, this apparatus further comprises a tensioning device intermediate the liner supply and the winding spool whereby any slack in the liner caused by the advancement or temporary acceleration is concurrently taken up whereby the tension in the liner intermediate the tensioning device and the winding spool is maintained In yet another aspect, the present application is directed to a detection and adjustment system for use in an interleafing winding process comprising a detector adapted to detect differences in the rate at which the interleaf material is being fed or drawn from the liner supply and/or the rate at which it is being taken up in the winding process and a rate adjuster which, in response to the detector, adjusts, at least on a temporary basis, the rate at which the liner material is fed or drawn from the liner supply. The interaction of the detector and the rate adjuster enables one to maintain a substantially constant, if not constant, tension in the liner material at the point where the material being wound and the liner are mated for winding (again, the "mating point"). In a preferred embodiment, the detection and adjustment system comprises (i) a plurality of rollers defining a liner pathway, two of which are stationary relative to a third, the third being intermediate the other two along the liner pathway and capable of reciprocating motion from a first point removed from the other two rollers and thereby defining a liner pathway of a preset or user determined operational length between the two stationary rollers and a second point which is closer to either or both of the stationary rollers and which defines a liner pathway there between which is of a preset or user determined length that is shorter than that associated with the first point of the reciprocating motion, (ii) a detector or sensor which, directly or indirectly, detects movement of the third roller indicative of at least a shortening of the liner pathway between the two stationary rollers or a change in tension in the liner material and (iii) a response element associated with the detector or sensor, which may be a part of or integrated into the detector or sensor, for directly or indirectly commanding a motor associated with the supply of liner material to advance or accelerate, on at least a temporary basis, the rate at which the liner is fed from the liner supply in response to a defined movement of the third roller.

The response element may be a mechanical element, such as a lever, associated with the detector which causes, directly or indirectly, the operation of the motor associated with the supply of liner material, or an electronic device or system which sends, directly or indirectly, an electronic signal to the motor or, conversely, which triggers operation of the motor when a circuit associated with the detector or sensor and the movement of the third roller is broken or, conversely, linked or completed. As noted, the third roller is capable of reciprocating movement and is preferably biased away from the stationary rollers so that any slack that may arise in the liner material resulting from the advancement or feed rate acceleration thereof is taken up by the movement of the third roller such that a tension or tautness is maintained in the liner material between the third roller and the subsequent stationary roller. This reciprocating motion may also be configured to stop the advancement or acceleration in the feed rate of the liner material. For example, as the third roller moves back away from the stationary rollers, it may, in the case of the electronic circuit activation, break the circuit or activate the circuit, as appropriate, which stops the previously triggered operation of the motor.

Tautness or tension in the liner material is maintained by use of a bias means associated with the reciprocating or third roller which, in the absence of other forces, biases the non-stationary third roller to a point removed from the two stationary second rollers. Exemplary biasing means include, but are not limited to, a helical spring, a coil spring, a pneumatic cylinder, a counter-weight, and the like. In a preferred embodiment, the response element is an electronic signaling means which effects operation of a motor associated with an axel upon which a spool of liner material is mounted.

In accordance with yet another embodiment of the aforementioned improved apparatus, the improved apparatus further comprises at least one and preferably a plurality of roller elements intermediate the winding element and the reciprocating or third roller of the tensioning apparatus which roller or rollers are double grooved rollers. Preferably, the improvement comprises the use of at least two double groove rollers intermediate the second stationary roller of the tensioning system and the winding roller. Most preferably, the double groove rollers are employed in a winding system having a closed loop configuration. The use of double grooved rollers has been found to markedly improve the alignment of the wound material on the liner material and the consistency thereof, even at high operational speeds, markedly reducing, if not eliminating, misalignment of the material being wound on the liner as manifested by the wound material extending beyond the edge of the liner and/or twisting of liner material during the winding process. In following, the use of double grooved rollers allows for faster winding processing with fewer defects, manifesting in overall improvements in production rate and quality. Additionally, the use of double grooved rollers has been found to allow for the use of a liner material whose width is the same as or substantially the same as that of the material being wound, even in a helical or transverse winding, further improving the overall process, especially from a cost perspective owing to reduced liner requirements.

The apparatus and processes described herein are applicable to most any winding process where a liner or interliner material is being used. They are especially applicable to those processes wherein the material being wound is flowable and/or manifests adhesive, sticky or tacky properties. In particular, the present apparatus and processes are especially suited for the winding of prepreg materials, most especially those materials that are of such widths that they must be wound in a helical or transverse winding. The present teachings are especially applicable and beneficial to the slitting and winding of prepreg materials, i.e., thermoset or thermoplastic impregnated fiber materials, especially those having longitudinally parallel fibers (along the axis of the tow).

BRIEF DESCRIPTION OF THE DRAWINGS

The accompanying drawings which form a part of the specification are to be read in conjunction herewith. Like reference numerals are employed to indicate like parts in the various views.

DETAILED DESCRIPTION

Figure 1:
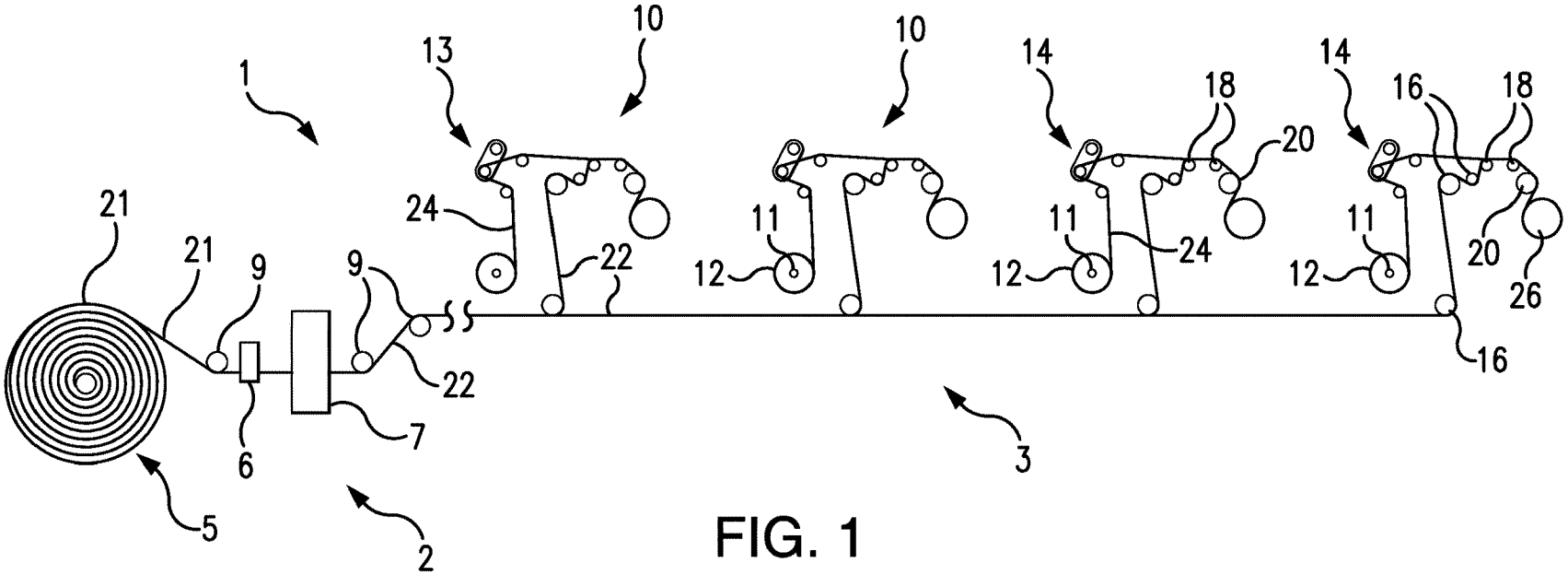
FIG. 1 is a schematic side view of a four head prepreg tape slitting and winding apparatus integrating the interleafing apparatus of the present teaching.

As used herein and in the appended claims, the following terms shall have the meanings as set forth below:

A "flowable material" refers to a solid, semi-solid, gel-like or putty-like material which is subject to creep, flow or movement at temperatures likely to be experience by the material during application/use, handling, storage and/or transport (excluding temperatures intentionally inflicted to induce cure or flow) and/or under conditions of pressure encountered during application, handling, winding, storage and/or transport (again excluding pressure intentionally applied to induce cure or flow). Typically, a flowable material is one that will creep, flow or move, most often without a visually apparent physical change, at temperatures below about 120° F., more typically below 100° F. and/or will show creep, flow or movement under its own weight in commercial stock windings thereof.

The term "interleaf winding" refers to that process by which a tow of a continuous length of a stock material, especially a thermoset or prepreg stock material, is mated with a continuous length of a liner or interliner material and wound about a spool, hub, spindle or the like whereby the stock material is isolated or separated from the previously wound stock material in the winding by the liner material. A cut through the winding perpendicular to the rotational axis of the winding will reveal two spirals, one of the stock material and one of the liner material, each layer of one sandwiched between successive layers of the other. Also, as used herein the terms liner and interliner are used synonymously.

The phrases "substantially constant, if not constant, tension" and "constant tension" refers to the existence of a sufficient tautness or positive tension in the liner material at the mating point so as to prevent a side-to-side or transaxial sway and/or a twisting in the liner material. Though preferred, it does not mean that the level of tension itself is maintained constant. While it may be desirable to maintain a constant or substantially constant level of tension in the liner tow at or immediately preceding the mating point, such is not critical so long as the necessary tautness or positive tension is maintained at that point. In this regard, it will be appreciated that the level of tension in the liner tow is, in part, a function of the liner tensioning apparatus according to the present teaching, as discussed below. Maintaining tautness in the liner material minimizes, if not prevents, the creation of any unevenness, slack, or irregularities in the winding and/or any misalignment of the liner with the stock material. Generally speaking, the tension in the liner should not exceed a predetermined level, which may be established by and/or is largely a function of a biasing means associated with the liner tensioning apparatus, as discussed below, as well as the physical properties of the liner material.

The present teachings are directed to an improved method and apparatus for the interleaf winding of materials wherein the improvement comprises integrating a liner tensioning apparatus into the pathway of the liner material prior to the point at which the liner and material being wound are mated (the "mating point") which liner tensioning apparatus is adapted to maintain a tautness or positive tension in the liner material at and/or immediately preceding the mating point. Specifically, the tensioning apparatus is adapted to detect a) changes in the tension of the liner material as it is being mated with the material being wound and/or b) differences in the rate at which the interleaf material is being fed or drawn from the liner supply and the rate at which it is being taken up in the winding process and when the detected change or difference exceeds certain predetermined or preset limits, the tensioning apparatus, directly or indirectly, causes or initiates a process by which an adjustment, preferably a temporary acceleration, in the rate at which the liner material is drawn from the liner material supply and/or fed to the mating point is effected.

While the apparatus and methods of the present teachings are applicable to any winding process in which a liner is necessary or desirable, it is especially applicable to those winding processes where the material to be wound is a flowable material and/or manifests adhesive, sticky or tacky properties and is in the form of sheets, strips, ropes, and the like. In particular, the present apparatus and processes are especially suited for the winding of prepreg materials, i.e., thermoset resin or thermoplastic impregnated fiber materials, including woven and non-woven fibrous materials. Most especially the present teachings are applicable to the process of slitting and winding of prepreg materials comprising a "continuous" master sheet, including master rolls (also known as parent rolls), of unidirectional fibers, typically carbon fibers, impregnated with curable resins, including, but not limited to epoxies, cyanate esters, bismaleimides, phenolics, polyimides, and the like: the slit product conventionally known as "slit tape."

In order to provide a better understanding and perspective of the present teachings, attention is drawn to FIG. 1 which depicts an exemplary slitting and winding system 1 having four spooling stations 10. For convenience, this discussion is being made with respect to prepreg materials which are being converted into slit tape, i.e., thin strips of the prepreg material; however, as noted above, this process and apparatus is applicable to any material to be slit and wound, most especially those that require the presence of an interliner. Furthermore, the apparatus and process is being described in terms of its most critical and basic elements, though those skilled in the art will readily appreciate the presence in the actual system of many other components and elements necessary for its proper operation such as additional rollers, guide elements, drive motors, and the like.

As shown in FIG. 1, the process is a continuous end-to-end process having two key operation centers, a conversion or converting center 2 and a winding center 3. The overall process starts with a master roll 5 of the prepreg material 21 and, in this depiction, ends with four spools 26 of slit tape 22 having a continuous length of a liner material 24 intermediate each winding of the slit tape. Intermediate these two ends are a number of operations and apparatus for converting the prepreg material 21 to slit tape 22 as well as a number of ancillary, though necessary, elements such as rollers, tension controllers, guide elements, etc.: some of which are depicted, many more of which are not, but are self-evident to those skilled in the art.

The converting center generally comprises two operations, a splicing operation and a slitting operation, preferably in this order. While, as noted below, the splicing operation is optional, it is especially important for the production of slit tape. In the process as shown, as the prepreg material 21 is unwound from the master roll 5 it first encounters a splicer 6. The splicer is employed to allow one to splice the terminal end of one master roll to the beginning end of another as the first is expired: thereby enabling continuous operation as well as the production of spools of slit tape of predetermined length, regardless of the length of the master rolls. The splicer typically comprises heating and compression elements (not shown) to facilitate the splicing. The splicing station may, and preferably does, also incorporate cutting means, e.g., a knife, cool laser, micro-knife, etc., in order to provide a clean cut to the tail end and/or leading end of each master roll, to excise a master roll for replacement with a new master roll of the same or a different material to be slit, or to insert a roll of a filler material, e.g., liner material, a polymer film or a non-woven polymer fiber sheet, to complete the slitting and winding operation on the material being slit and wound while concurrently priming the apparatus for subsequent use. In the latter instance, this is typically done when one is preparing the apparatus for shut down. By priming the apparatus, one does not need to manually feed the new material through the whole of the apparatus when the system is to be restarted with a new material since the pathways are already primed with the filler material. Rather, all that is necessary is to splice the new roll of material to be slit to the filler material and allow the system to run: the primer material will lead and pull the new material through the system and to the winders.

When not conducting a splicing operation, the splicing station is merely a pass-through station with the structure of the splicing station doing nothing more than, perhaps, helping with the proper alignment of the sheet material as it enters the slitting station 7. Specifically, those elements of the splicing station associated with the splicing operation or process itself are typically withdrawn or pulled back from the pathway of the prepreg sheet material and are only advanced to be in contact with the prepreg sheet material when a splice is to be made. Splicing techniques and their associated elements and apparatus are well known and commercially available from multiple sources and, therefore, further details and explanation thereof is not necessary.

The second operation encountered by the prepreg material in the converting center is the slitting operation. This is accomplished by a slitter 7 which slits the prepreg material into a predetermined number of tows of slit tape 22. Slitting may be accomplished by any of the known methods appropriate for the material being slit, e.g., precision, high strength blades, cool lasers, micro-knives, diamond knives, and the like. In the case of prepreg materials, it is preferred that the cutting be accomplished through a knife or blade system. Such systems are well known and commercially available and, therefore, further details and explanation thereof is not necessary.

Intermediate the converting center 2 and the winding center 3 are a plurality of alignment elements including rollers, guide posts, guide elements, positioning elements, tension controllers, aligners and the like, all of which are in the public domain and employed in conventional winding systems. These alignment elements are responsible for directing each tow of slit tape from the slitting station to its proper winding station and, ultimately, its intended spool or spindle element and, preferably, while maintaining a constant tension on the slit tape throughout this pathway. Not all systems will employ all of these elements. For example, systems configured to wind wide slit tape, i.e., those wound in a pancake coil, generally 3" or more in width, will require fewer of these elements than a system, as depicted in FIG. 1 which winds narrow slit tapes, i.e., those that are or must be transverse wound, generally 3" or less in width. Wide tape is typically wound on spools or reels mounted on a single axel opposite the exit end of the slitter with minimal redirection of the tapes.

Conversely, in the case of narrow slit tape, as shown in FIG. 1, the spooling or winding stations are typically mounted on one or more vertical walls or support structures, the winding stations on each wall or support structure preferably, coplanar with each other. A coplanar relationship is preferred, especially for enabling quick access to and removal of the filled spools. Thus, the alignment elements realign the slit tape tows from the generally horizontal co-planar relationship in which they exit the slitter to a stacked or vertical relationship as they reach the winding center. Furthermore, although the alignment of the spooling stations shown in FIG. 1 is linear, it is to be appreciated that there is no limit as to the alignment of the spooling stations on the vertical wall or support so long as the positioning of one does not interfere with the operation of another. For example, the spooling stations may be present as a plurality of rows, one over another, or they may be staggered, upper and lower, etc. in any event, as noted, the system comprises a number of alignment elements which serve to align the slit tape to provide an efficient, unobstructed pathway from the slitter to the spooling station without damaging the slit tape or causing it to twist along its longitudinal axis.

The key center of the slitting and winding system 1 as relates to the present improvement is the winding center 3. The winding center has two key functions, winding the slit tape 22 on the spool 26 and interleafing a liner material 24 between each winding of the slit tape 22. This process is accomplished at a plurality of spooling stations 10 each of which is typically mounted on or supported by a vertical wall or support structure (not shown). Each spooling station generally comprises an axel on which is mounted a spool, spindle, or bobbin and about which the slit tape is wound, which axel is directly or indirectly attached to or engaged with a drive motor for rotating the axel about its axis.

At each spooling station the slit tape is brought or guided to the spool by a plurality of rollers wherein positioning rollers 16 introduce and feed the slit tape to the mating point, alignment rollers 18 mate and align the slit tape with the liner, and placement roller 20 positions and places the mated slit tape and liner on the spool. Concurrently, a liner apparatus 13 feeds a liner material 24 from a liner material supply 12 to and aligns the liner material with the slit tape 22 for mating. In accordance with the present teachings, the liner apparatus further comprises a liner tensioning apparatus 14. The specific liner tensioning apparatus shown in FIG. 1 is more clearly depicted in FIGS. 2A and 2B (discussed further below); however, it is to be appreciated that the liner tensioning apparatus may take many other forms and iterations as taught herein.

As noted above, the key and central element of the improved process and apparatus of the present teachings is the liner tensioning system. In essence, any number of well-known and commercially available devices may be combined and adapted and the combination integrated into an existing interleaf winding system to perform the function of detecting changes in the tension of the liner material and/or detecting differences in the feed and take-up rate of the liner material and, in response to the detection of certain predetermined parameters, directly or indirectly, altering the rate at which the liner is fed or drawn from the source thereof, at least on a temporary basis, to maintain a tautness or constant tension in the liner material at or immediately prior to the point at which it is mated with the material being wound, generally the slit tape. In its simplest of iterations, the liner tensioning system comprises a detector means, a response means, and a tensioning means.

The detector means is adapted to detect changes in the tension of the liner material at or before the mating point and/or to detect differences in the rate of uptake of the liner by the winding spool as compared to the rate at which the same is fed from or drawn from the liner supply. Preferably, the detector means will comprise or have associated therewith preset parameters, limits, or triggers which, upon being met, causes, directly or indirectly, the activation, initiation, signaling, or instructing of the response means, as described below, to accelerate, at least on a temporary basis, the rate at which the liner material is fed or drawn from the liner supply. Most preferably the detector means and the response means are interconnected so that the acceleration in the feed or draw rate of the liner material is stopped once a second preset parameter or trigger is detected by the detector means or the parameter or trigger which initiates the response means to begin with no longer exists, i.e. is rectified by the accelerated feed of the liner material. The detector means generally comprises one or more switches, sensors and the like depending upon the specific interleaf winding system into which it is integrated and the specific design and elements of the tensioning apparatus as a whole.

Suitable sensors include transducers and loaded cell tension detectors, single and triple roller tension transducers, strain gauge sensors, etc. which detect tension in the tow of liner material. Alternatively, the sensor may be integrated into the unwinding unit, e.g., the axel on which a spool of the liner material is loaded, which sensor is configured to detect higher draw rate or pull of the liner material. Such a sensor could also be integrated into the spool winding motor or axel to detect an increase in resistance to the winding process; however, this configuration is less desirable as the cause for the increased resistance could also be an issue with the supply of material being wound.

Electronic and mechanical switches, especially electronic eyes, electrodes or electrical contacts, are also suitable for the present application. In these embodiments the tensioning apparatus has one or more stationary and one or more, preferably only one, non-stationary elements. These elements may be in the form of rollers, guides, pins, etc. (anything that will allow the liner to pass over or through it without snagging and, preferably, while maintaining its alignment). The stationary elements comprise or contain at least one element of the switch and define the limit, or, if there are two, the limits of movement of the non-stationary element. Specifically, one stationary element, the primary stationary element; is positioned to correspond to the maximum liner tension/shortest length of liner between the liner supply and the mating point allowed, the "advanced" position. A second stationary element, the secondary stationary element, if present, is positioned to correspond to the minimum liner tension/maximum length of liner between the liner supply and the mating point allowed, the "retracted" position. The retracted position is generally that position which coincides with the system at rest, i.e., in a non-operating mode. Alternatively, the retracted position may, and most typically will, coincide with the system in that operational mode when the length of liner material between the liner supply and mating point is at its maximum in-operation length, which may also be the rest mode. The non-stationary element is associated with the tension in and/or length of the liner material and is biased towards the retracted position and may or may not comprise a part of the switch or sensor. When the tension is low or the length of liner material between the liner supply and the mating point is at or near the maximum length, the non-stationary element is positioned at or near the secondary stationary element or the retracted position if no secondary stationary element is present. Conversely, when the liner tension is high or the length of liner material short, the non-stationary element is positioned at or near the advanced position. Generally speaking, however, the tendency and trend is for the non-stationary element to gradually move towards the advanced position owing to the difficulty in matching the rate of liner feed to the take-up rate from the winding process.

During processing, when the non-stationary element moves past or contacts the primary stationary element, it triggers the response means to induce or effect an acceleration in the rate at which the liner is fed from or drawn from the liner supply. This acceleration may be for or of a predetermined duration or its duration may be determined by the first or, if present, the second stationary element. In the former, the response means may be pre-programmed to accelerate the release of liner material for a set period of time or until a set length of material has been released. In the latter, if the trigger is an electric eye or an electrode or electric contact, the acceleration in the rate of feed or draw of the liner material may only proceed as long as the interference with the electric eye or the electric contact exists. Owing to the biasing of the non-stationary element to the retracted position, as additional liner material is released or fed, the non-stationary element will move back towards the retracted position, breaking contact with the electrode or electric contact or removing itself from the "vision" of the electric eye, thereby terminating the acceleration in the liner release rate. Alternatively, if a secondary stationary element is present, the acceleration of the release of liner material may continue until the non-stationary element passes or contacts the secondary stationary element. This latter configuration effectively provides separate on and off switches whereas in each of the previous embodiments the primary stationary element comprises a single on/off switch.

In yet another embodiment, the stationary elements may contain elements of an electro-mechanical switch, e.g., a toggle or sliding switch, which are moved from one position to another when the non-stationary element passes or contacts that switch. In this regard, when only a primary stationary element is present, the switch is physically moved or manipulated from an off position to an on position, but is biased towards the off position. In this configuration, when contact is made and the switch moved to the on position and liner released, the bias of the non-stationary element moves the non-stationary element back away from the switch and the bias of the switch element of the stationary element returns the same to the off position. Alternatively, the mechanical switch may comprise a slide switch one portion of which is positioned as the primary stationary element and another positioned as the secondary stationary element. When the non-stationary element moves past the primary stationary element, it slides the switch to an on position, concurrently moving the switch element of the secondary stationary element. When liner is released, the non-stationary element moves back to the retracted position, contacting and moving the switch element of the secondary stationary element back to the off position.

Finally, it is also contemplated that the switch may be a fully mechanical switch whereby the movement of the non-stationary element moves a lever or like device which in turn causes the acceleration in the liner release. This lever would be biased towards the non-active position so as to stop the acceleration in the liner release once the non-stationary element moves back, away from the lever.

The second critical element of the interliner tensioning apparatus is the response means. The response means is a device capable of and/or adapted to bring about an acceleration in the release (i.e., feed or draw) of the liner material from the liner supply. The specific device depends, in part, upon the nature of the liner material supply. For example, when the liner supply is a loose bale of the liner material, most typically a loose pack of the liner material in a bag, box or barrel, the liner is typically drawn from the supply by a plurality of pinch rollers, one of which is motorized or connected to a motor to cause its rotation. The pinch between the motorized roller and the second roller pulls the liner from the liner supply. To ensure proper alignment and avoid snags, the pinch roller apparatus typically has a loop element or eye bolt like element or other similar device having a small pass-through, e.g., a slit, through which the liner passes as it is drawn into the pinch roller. When the trigger or detector elements described above are activated, the pinch rollers will accelerate the rate of rotation to spew out additional length of liner material.

Preferably, the liner material is wound about a spool or spindle, either as a pancake coil or a transverse winding, which spool or spindle is mounted on an axel which is connected, directly or indirectly, to a motor. The motor may be active or passive. In the former, the motor assists in the unwinding of the liner material and is accelerated, increasing the rate of rotation of the axel, when activated or initiated by the detector means. In the latter, the axel is generally in a freely rotating state whereby the liner material is drawn from the liner supply by the pull of the liner material as it is being wound on the winding element. To avoid the unintended expulsion of excess liner material should the winding process suddenly stop, the axel may and preferably does have or is adapted to have a minor drag or resistance to its free rotation. The amount of drag or resistance is minimal so as to be readily overcome by the pull associated with the normal uptake of the liner material as the liner and slit tape is wound. In the passive system, when activated or initiated by the detector means, the motor, preferably a servo motor, engages the axel and accelerates its rotation. The duration of the acceleration may be predetermined or preset to run for a specified period of time or until a specified amount of liner material has been expelled. Alternatively, the duration may be responsive to the stimulus or instructions of the detector means, all as discussed in greater detail above.

In yet another embodiment, the spool or spindle of the liner material may be mounted on an axel whose rotation is restricted, requiring a certain pull tension in the liner to unwind the liner material. This is a passive liner dispenser in that the draw of the liner from the supply is purely line tension in the liner material arising from the winding process. The restriction in the axel rotation is most typically imposed by the presence of a braking element or like element which acts directly or indirectly upon the rotation of the axel. Specifically, the drag or resistance is either imposed directly on the liner axel or directly upon spool or spindle of liner material, which indirectly limits the rotation of the axel upon which it is mounted. In this instance, when the detector means is activated or initiated, the restriction on the axel rotation is removed or lessened, i.e., the extent of braking is lessened or removed altogether, whereby the tension in the tensioning means, as noted below, adds pull to the already tensioned liner material, accelerating its draw from the spool. The brake is reapplied once the stimulus for the removal or lessening thereof is removed.

The last and equally critical element of the liner tensioning apparatus is the tensioning means. The tensioning means is any device that is adapted to or capable of taking up the "additional" liner material expelled in response to the acceleration in the feed rate or draw rate of the liner material while concurrently maintaining a tautness or positive tension in the liner material at or immediately before the mating point in the winding process. The tensioning means is positioned in the liner pathway intermediate the liner supply and the mating point, most preferably in close proximity to the winding means, and is biased, typically by way of a helical spring, coil spring, counter-weight, or a pneumatic or hydraulic device, to increase the tension in the liner material. Though many devices may be employed, as those skilled in the art will readily appreciate, typically the tensioning means employs a dancer element or armature which reciprocates from a position corresponding to a long length of liner material between the liner supply and the mating point to a position corresponding to a short or shorter length of liner material between the liner supply and the mating point. It is to be appreciated that the tensioning means, or a portion thereof, is associated with or comprises or forms a part of the detector means: particularly the non-stationary element of the detector means.

Preferably the tensioning means comprises two stationary guide elements and one non-stationary guide element intermediate the other two with the non-stationary element most preferably mounted on a dancer arm or reciprocating armature. As noted above, the non-stationary guide element is preferably associated with the non-stationary element of the detector means. On the other hand, the stationary guide elements are most typically distinct from the stationary elements of the detector means. Furthermore, it is to be appreciated that the second of the stationary guide elements may serve as the mating point of the liner material and slit tape.

In operation, the non-stationary guide element reciprocates from a position in close proximity to one or both stationary guide elements (corresponding to the shortest liner path from the first to the second stationary element—the advanced position as noted above) to a position removed from the stationary guide elements (corresponding to a lengthy or longer liner path from the first to the second stationary element—the retracted position). The non-stationary guide element or the armature on which it is mounted is biased to the latter position, ensuring a tautness or positive tension in the liner material between the non-stationary element of the tensioning means and the mating point. The movement of the non-stationary guide element and/or the arm or armature on which it is mounted effects of forms a part of the detector, directly or indirectly triggering or leading to the activation of the response means. Suitable guide elements are any device that is capable of positioning and aligning the liner material along a set path. Typically the guide elements are rollers over which the liner passes or an eye bolt like element or other shaped element, such as those having a "J", "U", or "O" shaped portion through which the liner passes, or any combination of the foregoing; most preferably rollers.

The liner tensioning system may be incorporated into any apparatus or system used to wind tapes or strips of materials wherein the successive windings are or must be isolated from the prior winding. This is especially applicable to the winding of such tapes and strips made of or comprising a flowable material or an adhesive, tacky or sticky material, most especially prepreg materials. They may be integrated into the manufacturing process thereof or they may be integrated into converting systems and apparatus which convert master rolls of the sheet material into tapes or strips of the material, most especially slit tape. The incorporation and employment of the liner tensioning system and apparatus improves yields in terms of both quality and quantity, allowing for faster winding processes with less or minimal defects or out-of-specification product.

Having described the new liner tensioning system and its operation in general terms above, attention is now directed to the figures which depict various specific embodiments and iterations of the liner tensioning system and its integration into an interleaf winding system, particularly a prepreg slitting and winding system. Though not shown in all the figures, it is to be appreciated that the winding or spooling stations as well as the liner tensioning system and assemblies described and presented in the figures are mounted on a support structure or wall.

Figure 2A:
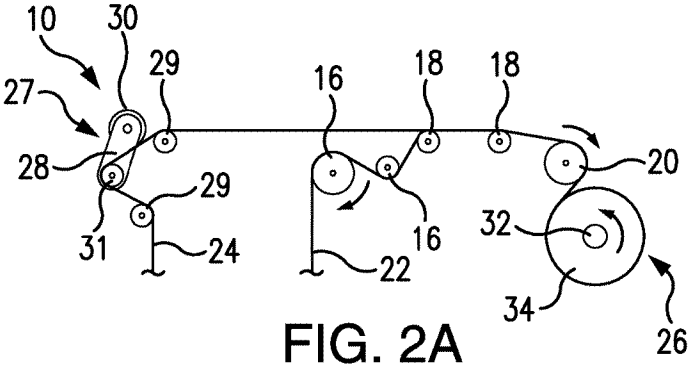
FIG. 2A is a schematic side view of a closed loop interleafing winding apparatus in accordance with a preferred embodiment of the present teaching.
Figure 2B:
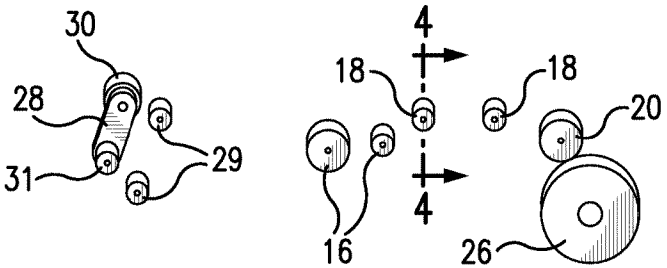
FIG. 2B is a schematic elevated side view of the closed loop interleafing winding apparatus of FIG. 2A.

FIG. 1, as noted above, depicts the general diagram of a slit tape system which integrates the interleaf winding apparatus of FIGS. 2A and 28. Specifically, FIGS. 2A and 2B depict a portion of a closed loop interleaf winding or spooling station 10 integrating a liner tensioning apparatus 27: FIG. 2A depicting a side view and FIG. 2B an elevated side view. The liner tensioning apparatus comprises three rollers, two stationary rollers 29 and a non-stationary roller 31. The non-stationary roller is mounted on a reciprocating armature 28 which is connected to and rotates about a hub 30: the hub being mounted on a support structure along with the other elements described.

The spooling station also comprises a plurality of roller and alignment elements including positioning rollers 16, alignment rollers 18 and placement roller 20 for introducing and feeding the slit tape 22 to the mating point at the first of the two alignment rollers 18, passing the mated slit tape and liner through the second alignment roller and to the placement roller and, finally, onto the spool 26. The spool in this particular figure is a pancake spool having side walls 34 for help in maintaining the pancake form and alignment of the subsequent windings, one directly overlaying the other. The spool 26 is mounted on a spool axel 32 which is driven or rotated by a motor, not shown. In this embodiment, the rotation of the axel, and hence the spool, during the winding process is counter-clockwise thereby enabling an inversion of the mated slit tape and liner as it is placed on the spool, i.e., the liner overlays the slit tape as the two approach the spool yet the liner lies under the slit tape as the two are wound on the spool.

Figure 5:
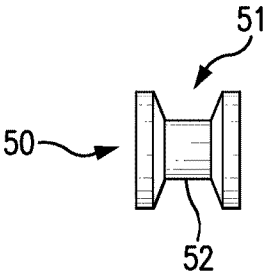
FIG. 5 is cross sectional view of a single grooved roller employed in the apparatus of FIG. 3A.
Figure 4:
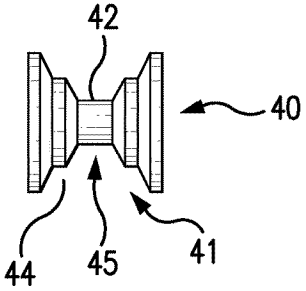
FIG. 4 is cross sectional view of a double grooved roller employed in the apparatus of FIG. 2A.

Typically the positioning and alignment rollers are standard rollers 50 having a single groove 51 about the roller core 52, all as shown in FIG. 5. The placement roller 20 may be a grooved, but is preferably a flat roller, like a rolling pin. Most preferably, however, give the particular configuration or alignment of the liner tensioning system and the slit tape feed pathway in this embodiment, it is especially desirable to use double grooved rollers, particularly as the alignment rollers 18. As shown in FIG. 4, double groove rollers 40 employ two overlaying recesses 41, an upper circumferential groove or recess 44 overlaying a narrower circumferential groove or recess 45 about the roller core 42. The depth of each groove is dependent, in part, upon the thickness of the slit tape and liner materials. Similarly, the width of each groove is coordinated such that the narrower groove is the same as or slightly wider than the width of the slit tape and the wider groove is the same as or slightly wider than the width of the liner. By controlling the width of the upper groove 55, especially by minimizing the difference in widths of the two grooves, one can use a liner material whose width is the same as or nearly the same as that of the slit tape. This combination of the double grooved rollers and the liner tensioning system facilitates the use of thinner width liner material, meaning less liner material overall and lower costs, as well as higher speeds. Specifically, this combination provides more accurate and consistent alignment of the slit tape on the liner material.

Figure 3A:
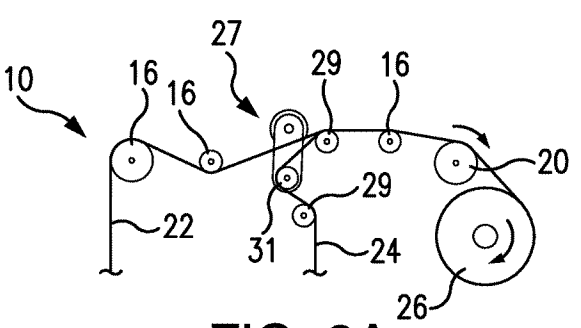
FIG. 3A is a schematic side view of an alternate alignment of a closed loop interleafing winding apparatus in accordance with a preferred embodiment of the present teaching.
Figure 3B:
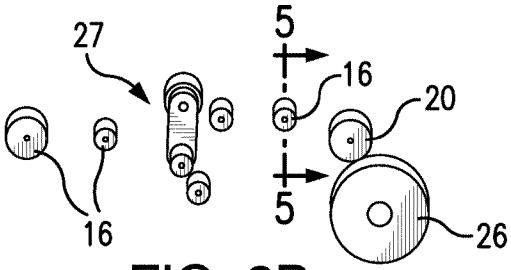
FIG. 3B is a schematic elevated side view of the closed loop interleafing winding apparatus of FIG. 3A.

FIGS. 3A and 3B depict an alternate version of the closed loop winding station 10 shown in FIGS. 2A and 2B: FIG. 3A a side view and FIG. 3B an elevated side view. This version is identical to that of FIGS. 2A and 2B, and hence the same elements and numbering, except that the positioning or alignment of the liner tensioning apparatus 27 and the slit tape pathway and the rotation of the spool 26 are reversed. Here, when the liner and slit tape are mated, the slit tape lies on top of the liner rather than the liner on top of the slit tape, consequently, spool 26 must rotate clockwise as opposed to the counter-clockwise rotation in the embodiment of FIGS. 2A and 2B to accommodate this configuration.

Figure 6:
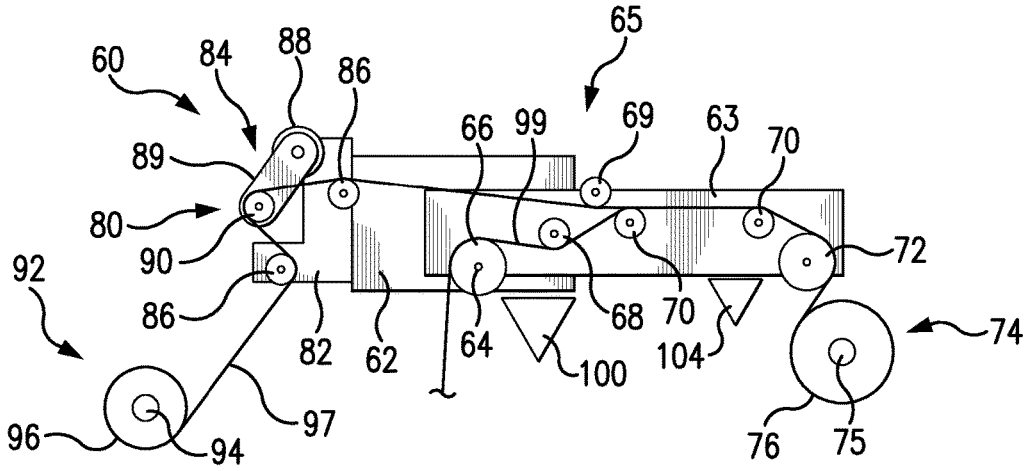
FIG. 6 is a schematic side view of a closed loop interleafing transverse winding apparatus in accordance with a preferred embodiment of the present teaching.
Figure 7:
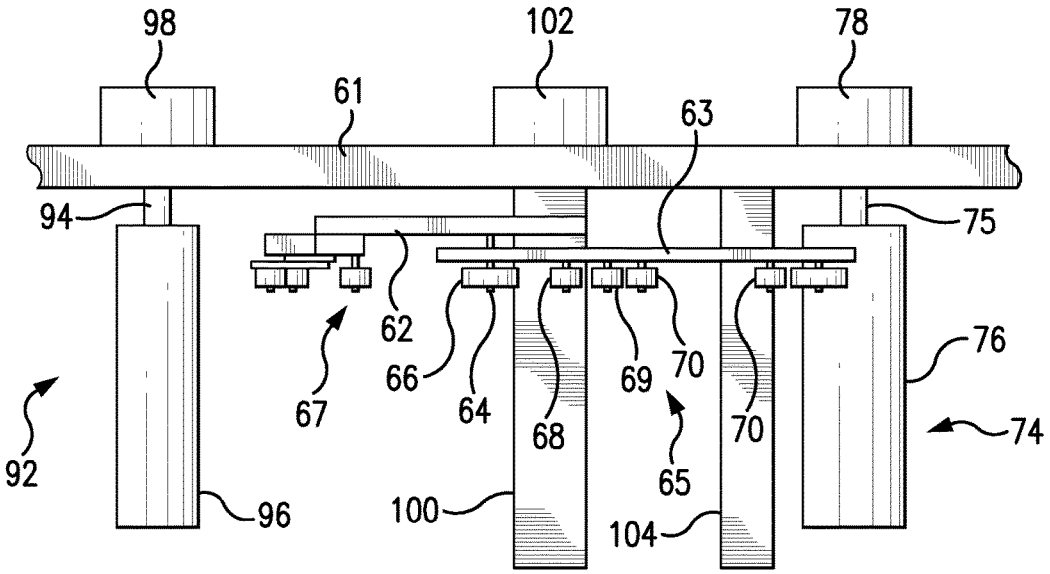
FIG. 7 is a schematic top view of the closed loop interleafing transverse winding apparatus of FIG. 6 at a first position.
Figure 8:
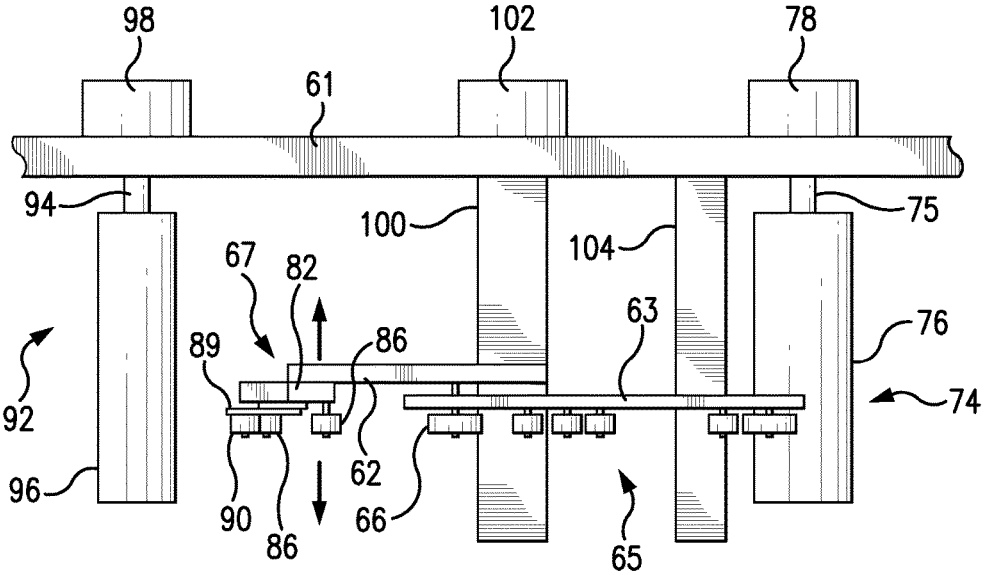
FIG. 8 is a schematic top view of the closed loop interleafing transverse winding apparatus of FIG. 6 at a second position.

FIGS. 6 thru 8 depict a closed loop transverse winding or spooling station 60 which performs a transverse winding of the liner/slit tape combination upon a spindle type spool element 76. Transverse winding is a winding process that provides a helical winding by concurrently winding a material circumferentially and longitudinally along the length of the spindle spool wherein one layer of the wound material overlays another in a crosswise pattern. Successive layers of the winding are applied as a carriage assembly upon which the winding placement elements are mounted reciprocates along the spool length until the desired length of material is wound.

The FIG. 6 is a face-on side view of the transverse winding spooling station while FIGS. 7 and 8 are top down views. The transverse spooling station comprises a plurality of assemblies and elements mounted on a superstructure or wall 61 including a liner supply assembly 92, a winding spool assembly 74, a moveable carriage assembly 67 upon which is mounted an liner tensioning assembly 84 and slit tape/liner placement assemblies 65, and a motorized worm shaft/axel assembly 100 and guide bar 104 upon which the carriage rides as the apparatus winds the slit tape/liner material in a transverse pattern on the spool. FIG. 7 depicts the carriage 67 at the starting point of the transverse winding while FIG. 8 depicts the carriage at a point about two-thirds of the way along the transverse winding path: the carriage movement symbolized by the arrows in FIG. 8. With the exception of the liner tensioning assembly 84, the remainder of the elements and alignment are well known and employed commercially. For that reason, the following description of the transverse winding station, again with the exception of the description of the liner tensioning assembly, will be cursory in nature.

The liner supply assembly 92 comprises a spool 96 of liner material 97 mounted on an axel 94 whose rotation is enabled or supplemented by a motor 98 on the opposite side of the superstructure 61.

The winding spool assembly 74 comprises a spindle type spool element 76 on which the slit tape/liner material is wound. The spool is mounted on a spool axel 75 whose rotation is controlled by motor 78.

Transverse winding of the slit tape/liner combination is accomplished by means of a carriage assembly 67 and a motorized worm shaft/axel assembly 100 on which the carriage rides. Operation of the worm is controlled by motor 102 which is connected, directly or indirectly, e.g., by one or more gear elements, to the worm element (not shown) of the motorized worm shaft/axel assembly. The worm element has a continuous crisscrossing helical groove in its circumferential surface which engages a non-rotating slide element associated with the carriage assembly whereby as the worm is rotated in response to the action of motor 102, the slide element moves along the groove, carrying with it the carriage assembly.

The carriage assembly itself is comprised of structural elements and non-structural elements, the latter comprising the liner tensioning assembly 84 and the slit tape alignment, positioning and placement guides, rollers, and the like, all of which are mounted on the structural elements. The specific embodiment shown in FIGS. 6 thru 8 employs a carriage body having a liner tensioning assembly support 82 upon which is mounted the individual elements of the liner tensioning assembly 84 or the whole of the assembly may be mounted to the support as a single unit. The carriage body also has a slit tape alignment and positioning arm 63 upon which are mounted a plurality of rollers for aligning, positioning and placing the slit tape 99 on the spool 76. Of course, it is to be appreciated that other equivalent elements, such as guide elements or posts could be used in place of the rollers or certain of the rollers, as will be appreciated by those skilled in the art. The alignment and positioning arm 63 has a proximal end corresponding to the feed of slit tape 99 from the source thereof and the fore end corresponding to the point at which the mated slit tape and liner combination are positioned for transfer to or placement on the spool.

The liner tensioning support 82 and the positioning arm 63 are each adjoined to a carriage body 62 which is associated with, most preferably directly connected to, the aforementioned slide element which rides on the worm of the motorized worm shaft/axel assembly 100 and is responsible for the reciprocating movement of the carriage assembly as a whole. Although each of these structural elements are shown as individual elements in the figures, it is to be appreciated that any two or all three of these support or structural elements could just as easily be formed as a single structural piece.

As noted, the carriage assembly as a whole is moveably mounted on the worm shaft/axel assembly 100. While the critical connection between the two is the slide element, it is to be appreciated that there is preferably a secondary connection which prevents the one from disengaging the other, especially during operation, and so that the full force or weight of the carriage assembly is not borne by the slider and worm element. Though not shown, those skilled in the art will appreciate that there are preferably one or more bores through the carriage body 62, the axis of which is parallel to the longitudinal axis of the worm element, and through which extend a similar number of rail elements associated with the worm shaft/axel assembly. These rails bear all or at least the brunt of the weight of the carriage assembly yet allow the carriage assembly to smoothly travel and reciprocate along the length of the rails.

A second support, guide bar 104, is also employed to maintain the proper orientation of the positioning arm 63. This support may be stationary or non-stationary and is positioned near the fore end of the positioning arm, in close proximity to the spool so as to counteract the pulling force of the spool assembly as the slit tape is being wound. If the guide bar is stationary, it is positioned so that the positioning arm, most notably the placement roller 72 on the positioning arm, is removed from the spool even when the fully wound. Alternatively, the guide bar may be adapted to move as the winding on the spool grows so as to maintain a constant distance between the placement roller and the spool. This latter configuration minimizes any opportunity for the slit tape 99 and liner 97 to disengage from each other, to shift relative to one another, or to twist. Here, the guide bar is associated with a motorized conveyor means or lift which raises the guide bar, and hence the fore end of the positioning arm, as more and more slit tape is wound and then returns to its starting position when exchanging out the full spool with a new or empty spool. With this configuration, the positioning arm 63 is a separate element and is adapted to pivot, preferably about axel 64.

As noted, the positioning arm has mounted thereon a plurality of roller elements including slit tape positioning rollers 64 and 68, liner positioning roller 69, slit tape/liner alignment rollers 70, and placement roller 72. Slit tape positioning rollers 64 and 68 and liner positioning roller 69 align and position the slit tape and liner, respectively, for proper mating at the mating point, i.e., at the first of the two alignment rollers 70. Alignment rollers 70 align, i.e., center, the slit tape on the liner material (though it is to be appreciated that the two are inverted with the liner on top of the slit tape in the roller). Most preferably, and as depicted in these figures, the alignment rollers are double grooved rollers as discussed above. The combined tow of slit tape and liner is then passed to placement roller 72 which positions the winding on the spool 76.

New to this configuration of a winding system and the critical feature of the present teachings is the liner tensioning apparatus 84. The liner tensioning apparatus shown in FIGS. 6 thru 8 is identical to that shown in FIGS. 2A and 2B except that it is mounted on a carriage assembly, notably the liner tensioning support structure 82. Specifically, the liner tensioning apparatus 84 comprises three rollers, two stationary rollers 86 and a non-stationary roller 90. The non-stationary roller is mounted on a reciprocating armature 89 which is connected to and rotates about a hub 88: the hub being mounted on the support structure along with the other elements described.

Figure 9A:
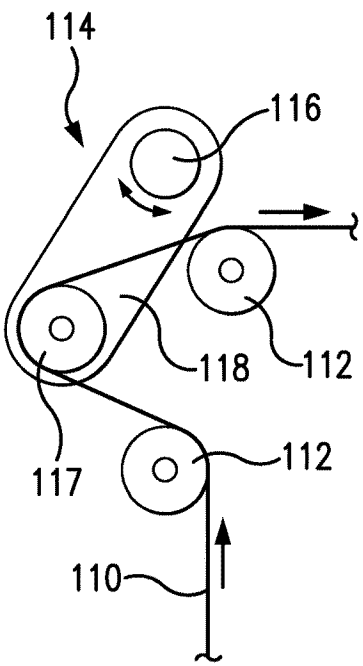
FIGS. 9A thru 9E are schematic depictions of the movement of the armature of an interleaf tensioning apparatus.

Operation of a liner tensioning apparatus similar to that shown in FIG. 6 is reflected in FIGS. 9A thru 9E. Specifically, FIG. 9A shows a liner tensioning apparatus 114 having two stationary rollers 112, and a non-stationary roller 117 mounted on reciprocating armature 118 which rotates or reciprocates about hub 116, as noted by the double arrow, and which is biased away from the stationary rollers.

FIG. 9A shows the system at rest with the reciprocating armature fully extended and the non-stationary roller removed from the stationary rollers. This corresponds to the situation where the length of the liner pathway through the liner tensioning apparatus is at a maximum.

Figure 9B:
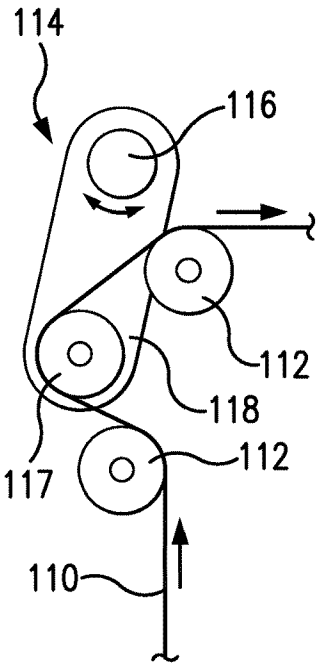

FIG. 9B shows the liner tensioning apparatus in operation with the non-stationary roller having moved closer to the stationary rollers owing to the operating tension of the system arising from rotation of the spool element and winding of the slit tape and liner and a concurrent shortening of the liner path through the liner tensioning apparatus.

Figure 9C:
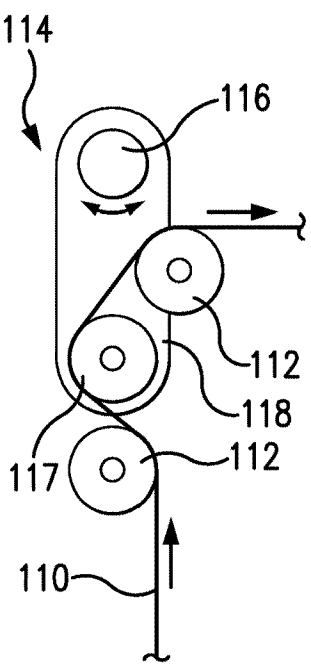
Figure 9D:
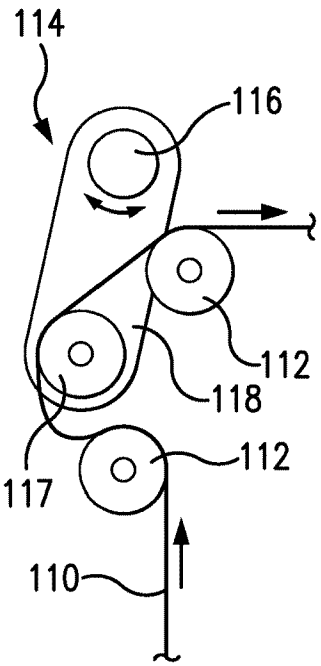

FIG. 9C depicts that point at which the liner path through the tensioning apparatus reaches a minimum and triggers a response from the response means, liner motor 98 (FIG. 6). In this case, the liner motor 98 (FIG. 6) is temporarily activated or accelerated to affirmatively spew out or release a length of liner material. The release is reflected in FIG. 9D where a slackening in the liner 111 is shown. However, the slack is short lived as it is quickly taken up by the bias and movement of the reciprocating armature 118. The nature of the biasing means associated with the reciprocating armature is such that the slack in the liner tow prior to the non-stationary roller is not detected or does not materialize or is minimal in the liner tow between the non-stationary roller and the second stationary roller, as shown in FIG. 9D.

Figure 9E:
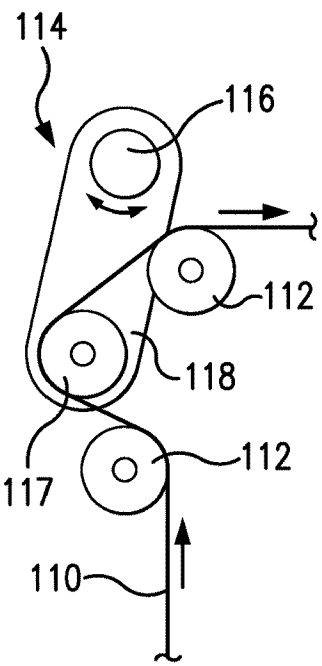

Finally, FIG. 9E shows the liner tensioning apparatus back in a normal operating state with a positive tension along the whole length of the liner pathway, especially through the liner tensioning apparatus.

As noted above, the tensioning armature is biased away from the stationary rollers in an effort to maximize or increase the liner pathway through the liner tensioning apparatus. Many different means and configuration of components can be used to create this bias as well as detect changes in the position of the tensioning armature, vis-à-vis the stationary rollers. Several devices and iterations are shown in FIGS. 10, 11A, 11B, 12A, 12B, 13, 14 and 15.

Figure 10:
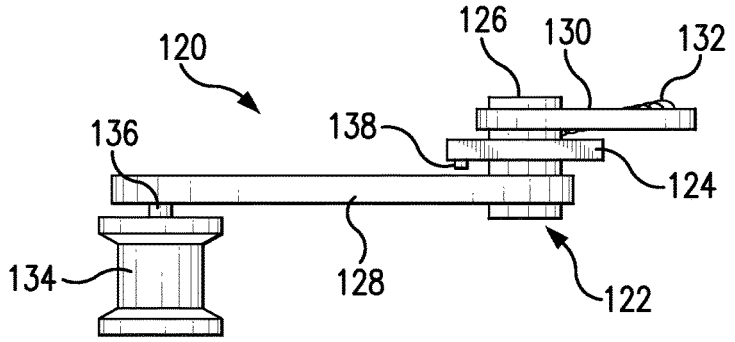
FIG. 10 is a schematic top view of a helical spring-based interleaf tensioning armature.

FIG. 10 shows a reciprocating, helical spring biased tensioning armature device 120 attached to a support structure 124; the latter of which comprises or is itself attached to the support structure or wall of the pancake winding system or the carriage of the transverse winding system. The tensioning armature device is comprised of a tensioning armature 128, a biasing arm 130 and an armature axel 126 connecting the two and to which the two are fixed, i.e., the tensioning armature, armature axel and biasing arm all rotate or reciprocate together. The armature axel passes through a non-interference bore in the support structure 124, thereby holding the tensioning armature and tensioning arm in place while allowing for its reciprocation. Preferably, as shown in FIG. 10, the tensioning armature and the biasing arm are on opposite sides of the support structure 124 with one end of each fixedly attached to opposite ends of the armature axel. At the opposite end of the tensioning armature 128 is a roller 134, the non-stationary roller of the tensioning system, attached by roller axel or spindle 136. At or near the opposite end of the biasing arm 130 is an attachment for helical spring 132 whose opposite end 133 is attached to the support structure 124 (as better shown in FIGS. 11A and 118).

Figure 11A:
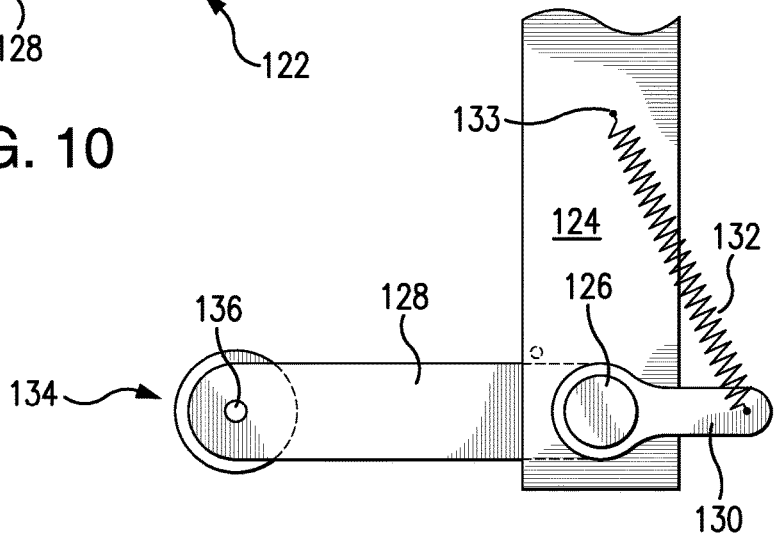
FIGS. 11A and 11B are schematic side views of the helical spring-based interleaf tensioning armature of FIG. 10 in an extended position and a retracted position, respectively.
Figure 11B:
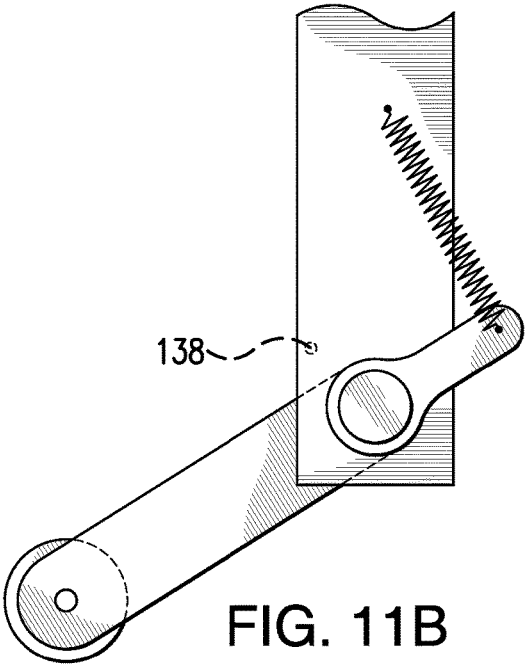

FIGS. 11A and 11B are face on views of the helical spring controlled tensioning armature device 120 of FIG. 10 from the back, i.e., the biasing arm is in front of the support structure 124 and the tensioning armature is behind the support structure. FIG. 11A shows the apparatus with the helical spring fully extended, which coincides with the liner path through the tensioning device being at is shortest. It is at this point that a detector or sensor 138 mounted on the support structure is triggered by the movement of the tensioning armature causing or initiating an acceleration in the rate of expulsion of liner material from the liner supply. FIG. 11B, on the other hand, shows the helical spring in a retracted state coinciding with a longer liner path through the tensioning device and the tensioning armature having moved back away from the detector or sensor 138.

Figure 12A:
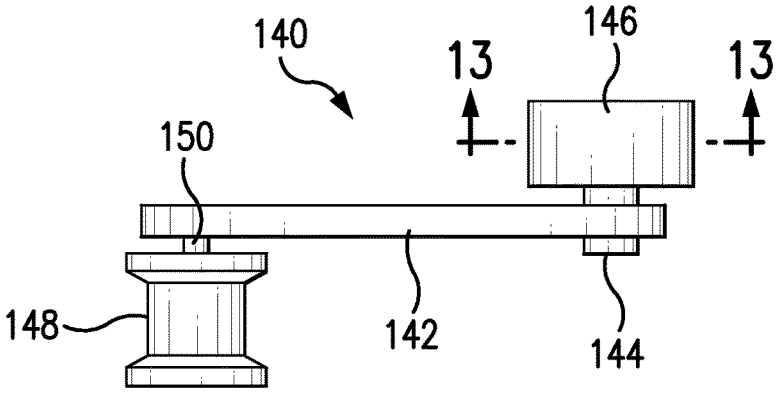
FIG. 12A is a schematic top view of a coil spring based interleaf tensioning armature.
Figure 12B:
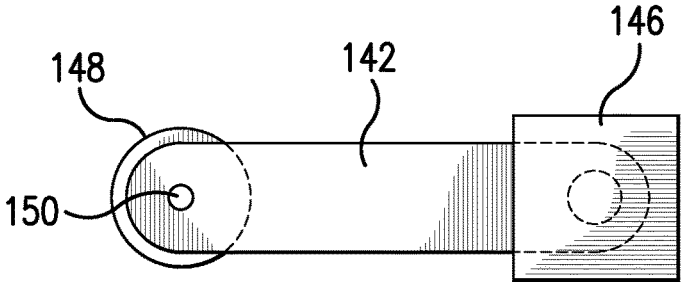
FIG. 12B is a schematic rear side view of the coil spring based interleaf tensioning armature of Fig, 12A.
Figure 13:
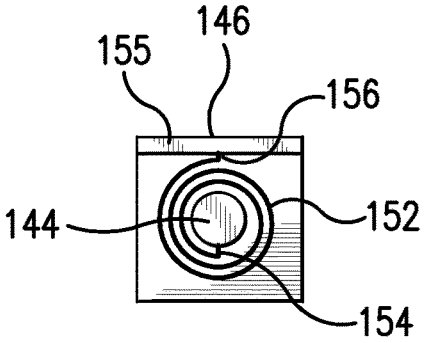
FIG. 13 is a cross-sectional view of the coil spring tensioning element of the armature of FIG. 12A along line 13-13.
Figure 14:
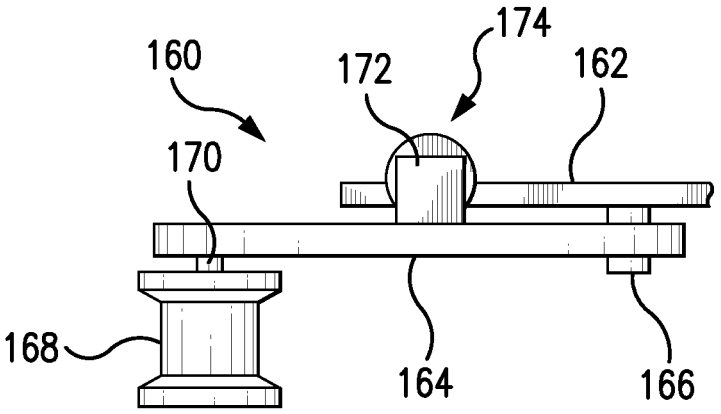
FIG. 14 is a schematic top view of a pneumatic/hydraulic operated tensioning armature.
Figure 15:
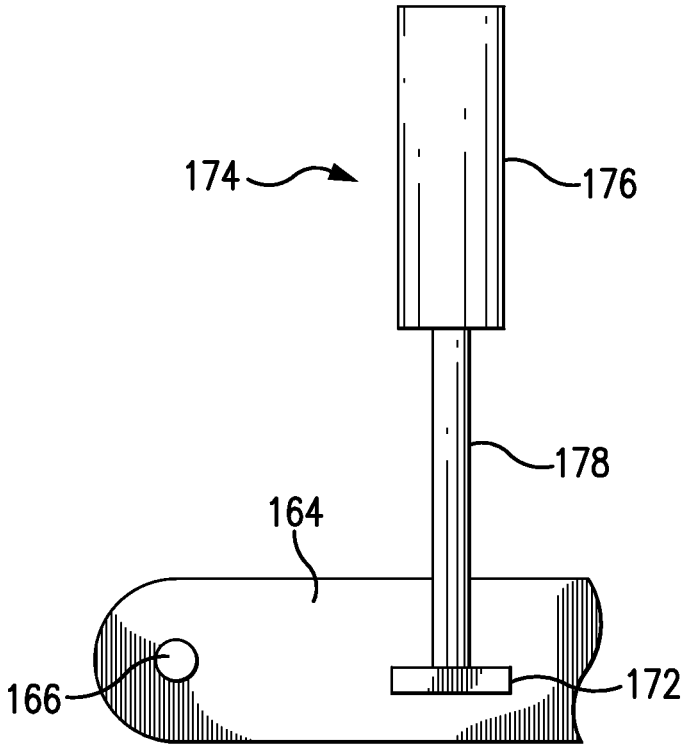
FIG. 15 is a partial schematic rear view of the pneumatic/hydraulic operated tensioning armature of FIG. 14.

FIGS. 12A and 12B show a coil spring biased tensioning armature device 140 attached to a support structure 146; the latter of which comprises or is itself attached to the support structure or wall of the pancake winding system or the carriage of the transverse winding system. The tensioning armature device is comprised of a tensioning armature 142 having a roller 148 attached to one end thereof by a roller axel or spindle 150 and is fixed at its opposite end to a spring axel 144 whereby movement of the tensioning armature causes a rotation of the spring axel 144. As seen in FIG. 13, which is a cross-sectional view of the support structure 146 along line 13-13, the support structure is adapted to contain a coil spring 152 whose core end 154 is affixed or attached to the spring axel 144 and whose terminal end 156 is affixed or attached to a coil spring base mount 155 within or comprising a part of the support structure 146. Thus, as the tensioning armature moves towards the stationary rollers the coil spring compresses, increasing the tension in the spring, and as the tensioning armature moves back away from the stationary rollers, the coil expands and tension is reduced. These changes in tension within the coil spring are detected by a sensor (not shown) which, in response to a set increase in tension, effects or activates a motor associated with the liner supply for effecting or initiating an acceleration in the rate of expulsion of the liner material from the liner supply. This tension is lessened as liner material is release and the tensioning armature returns to a position removed from the stationary rollers (refer to FIGS. 9A thru 9E).

Figure 16A:
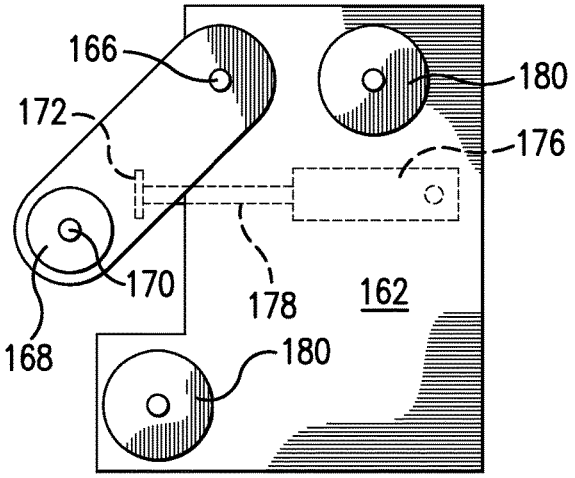
FIGS. 16A thru 16C are schematic front view depictions of three points of operation of the piston spring/pneumatic operated tensioning armature of FIG. 14.

FIGS. 14, 15 and 16A thru 16C present yet another type of liner tensioning assembly, a pneumatically or hydraulically biased tensioning assembly 160 attached to a support structure 162; the latter of which comprises or is itself attached to the support structure or wall of the pancake winding system or the carriage of the transverse winding system. As in the previous iterations, the assembly comprises a tensioning armature 164 having a roller 168 affixed to one end by an axel or spindle 166 about which the roller rotates. In this embodiment, the opposite end of the tensioning armature has a bore through which an armature axel or spindle 170 extends and about which the tensioning armature rotates or reciprocates. The tensioning armature also has extending therefrom piston plate 172 which is impacted upon by the piston 178 of the pneumatic or hydraulic piston mechanism 174 comprising pneumatic or hydraulic cylinder 176. Pneumatic or hydraulic cylinder 176 pushes the piston against the plate, thereby biasing the tension armature 164 away from the stationary rollers 180 (FIG. 16A).

Figure 16B:
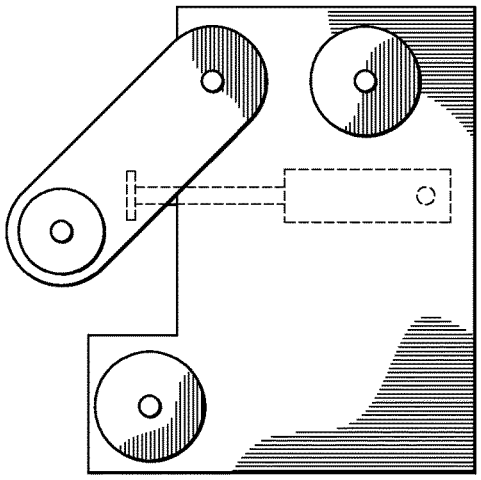
Figure 16C:
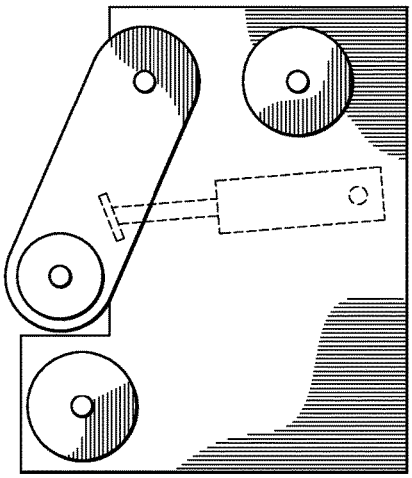

As noted previously, during the winding process the rate at which the liner is released from the liner supply is typically slower than the rate of its consumption. This, in turn, results in a shortening of the liner path through the liner tensioning assembly and movement of the tensioning armature close to the secondary rollers (FIG. 16C). Concurrently, the piston 178 is forced back into the pneumatic or hydraulic cylinder 176 thereby increasing the pressure within the cylinder. A sensor in or associated with the cylinder detects the pressure difference and, once a predetermined pressure is attained, activates the motor on the liner supply to temporarily accelerate the rate of release of liner. The force of the piston on the piston plate causes the tensioning armature to move back, away from the secondary rollers (FIG. 16B). In turn, the pressure in the cylinder is lessened, returning to a second predetermined level associated with acceptable operation.

Up to this point, it is to be noted that the discussion has focused on the sensor or detector being associated with or integrated into the biasing means or positioned to be effected by the movement of the tensioning armature. In those embodiments, activation or acceleration of the liner supply motor is responsive to the sensor whereby the duration of the acceleration of the liner supply motor is predetermined, i.e., once triggered it expels liner material for a given time or length of material or is a function of the duration of the stimulus triggering or setting off the sensor, i.e., acceleration stops once the tensioning armature loses contact with or moves out of sight of the sensor, the tension in the spring or the pressure in the cylinder is lessened, etc. Alternatively, it is to be appreciated that the liner tensioning system may employ a plurality of sensors or detectors, one of which triggers or initiates the rate acceleration of the liner supply motor and the other of which terminates the rate acceleration.

FIGS. 17A thru 17E present a schematic representation of the operation of a system employing two sensors, the first, an on sensor 189, which activates acceleration of the liner supply motor and the second, a stop sensor 187, which terminates the same. For simplicity only a portion of the tensioning armature 185, that portion which interacts with the sensors, is shown. However, for ease of understanding, it is to be appreciated that FIGS. 17A thru 17E correspond to the positioning of the armature and secondary rollers as presented in FIGS. 9A thru 9E, respectively. Furthermore, it is to be appreciated that this configuration is applicable to any of the liner tensioning systems described in this specification.

Figure 17A:
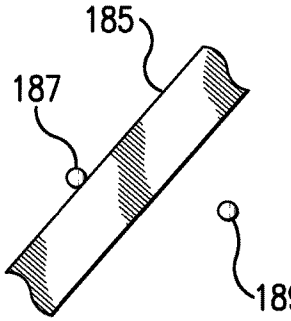
FIGS. 17A thru 17E is a schematic sequence drawing of a portion of a tensioning armature as it moves from one extreme to the other in a dual-switched tensioning armature apparatus.
Figure 17B:
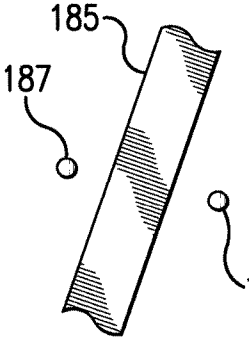
Figure 17C:
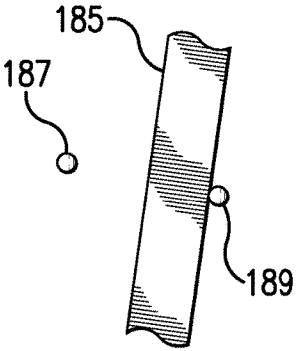
Figure 17D:
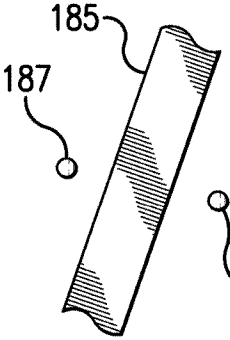
Figure 17E:
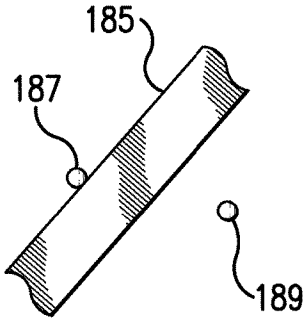

FIG. 17A shows the tensioning system at its initial or starting position with the tensioning armature in contact with stop sensor 187. FIG. 17B shows the advancement of the tensioning armature 185 towards the on sensor 189 during operation of the winding system. FIG. 17C shows the point of advancement of the tensioning armature whereby the armature contacts or passes in front of the on sensor 189. This, in turn, activates or initiates the acceleration of the liner supply motor, thereby causing an acceleration in the expulsion of the liner material from the liner supply. Consequently, FIG. 17D shows the movement of the tensioning armature away from the on sensor and towards the stop sensor. Finally, FIG. 17E shows the tensioning armature in contact with or passing by the stop sensor which, in turn, signals the liner supply motor to stop the acceleration of the expulsion of feeding of liner material. As shown, stop sensor 187 and on sensor 189 may be electric eyes, electronic contacts, or toggle type switches. Where the sensors are electronic contact switches, the tensioning armature will have a corresponding electric contact to create or break, as appropriate, the electronic circuit.

Figure 18:
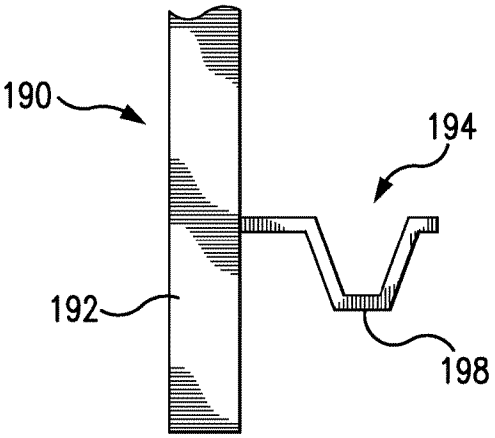
FIG. 18 shows a "U" shaped guide element.

As noted above, the slitting and winding system as shown in FIG. 1 includes, as necessary, a plurality of guide, alignment and positioning elements, including rollers, guide bars, posts and the like, that for the sake of simplicity are not included in the figures. Such elements and their positioning are self-evident to those skilled in the art and employed in currently commercial systems. This is especially so for the transverse winding system where such elements are employed to direct the slit tape to the carriage, even as the carriage reciprocates on the motorized worm shaft/axel assembly and associated guide bar. Furthermore, while the alignment and positioning elements in the foregoing embodiments and figures have been identified as rollers, it is to be appreciated that many of these, especially those associated with liner tensioning system or apparatus, may be replaced with guide element as shown in FIG. 18. Specifically, FIG. 18 depicts a portion of a liner tensioning apparatus wherein the tensioning armature 192 has attached thereto a "U" shaped guide element 194 formed of a rod wherein the trough of the "U" 198 serves the same purpose as the groove of the roller, as described above.

While the method and apparatus of the present specification have been described with respect to specific embodiments and figures, it should be appreciated that the present teachings are not limited thereto and other embodiments utilizing the concepts expressed herein are intended and contemplated without departing from the scope of the present teaching. Thus true scope of the present teachings is defined by the claimed elements and any and all modifications, variations, or equivalents that fall within the spirit and scope of the underlying principles set forth herein.

I claim:

1. An apparatus for interleaving a stock material with a liner material in an interleaf winding process, an interleaf winding process being a process that mates a continuous tow of a stock material with a continuous tow of a liner material, the mating point, before or concurrent with the winding of the mated materials on a spool, spindle, bobbin, reel or like core element, the liner material originating from a liner supply, said apparatus, in use, positioned intermediate the liner supply and the mating point and comprising a) a tensioning device or means comprising (i) at least one stationary element, (ii) at least one non-stationary element, said at least one stationary element and said at least one non-stationary element defining a path for the liner material through the tensioning device or means and to the mating point, (iii) a dancer element or a reciprocating tensioning armature device having a fixed end relative to the stationary element and a reciprocating end which comprises or upon which is seated the non-stationary element such that the non-stationary element is capable of moving in a reciprocating fashion along a path that, at one extreme, corresponds to the longest path for the liner through the tensioning device or means to the mating point and, at a second extreme, corresponds to the shortest path for the liner through the tensioning device or means to the mating point, and (iv) a helical or coil spring biasing means acting upon the dancer element or reciprocating tensioning armature device which helical or coil spring biasing means biases the non-stationary element towards the first extreme position corresponding to the longest liner supply path, b) a detector or sensor element or means for detecting at least one of 1) movement of the dancer element or reciprocating tensioning armature device and, hence, movement of the non-stationary element along the aforementioned path, 2) changes in the tension of the liner material and/or 3) differences in the rate at which the liner material is being fed or drawn from a the liner supply and the rate at which it is being taken up in the winding, process, and c) a response element or means responsive to the detector or sensor element or means adapted to effect an acceleration, on a temporary basis, in the rate at which the liner material is fed or drawn from the liner supply to the tensioning device or means, said elements (a), (b) and (c) adapted and aligned to maintain a constant tension in the liner material at the point where the liner material and the stock material being wound are mated.

2. The apparatus of claim 1 wherein the detector or sensor element or means detects (1) movement of the dancer element or reciprocating armature device and, hence, movement of the non-stationary element along the aforementioned path.

3. The apparatus of claim 1 wherein the detector or sensor element or means detects (2) changes in the tension of the liner material between the liner supply and tensioning device or means.

4. The apparatus of claim 1 wherein the detector or sensor element or means detects (3) differences in the rate at which the liner material is being fed or drawn from the liner supply and the rate at which it is being taken up in the winding process.

5. The apparatus of claim 1 wherein each of the detector or sensor elements or means and each of the response element or means are independently a mechanical device or element or an electronic device or system.

6. The apparatus of claim 5 wherein at least one of the detector or sensor elements or means is an electro-mechanical device or element.

7. The apparatus of claim 1 wherein the response element includes or is associated with a motor associated with the liner supply which temporarily advances or accelerates the rate at which the liner material is fed or drawn from the liner supply.

8. The apparatus of claim 7 wherein the detector or sensor element or means is a trigger type means whereby the duration and/or extent of the advancement or acceleration in the rate at which the liner material is fed or drawn from the liner supply is preset.

9. The, apparatus of claim 7 wherein the detector or sensor element or means is an on-off type element or means whereby the temporary advancement or acceleration in the rate at which the liner material is fed or drawn from the liner supply initiates when turned on and terminates when turned off.

10. The apparatus of claim 1 wherein the tensioning device comprises at least two stationary elements and a single non-stationary element wherein the non-stationary element is situated between two stationary elements along the pathway of the liner material through the tensioning device or means.

11. The apparatus of claim 1 wherein at least one stationary element is, situated before the non-stationary element along the path of the liner through the tensioning device or means.

12. The apparatus of claim 1 wherein at least one stationary element is, situated between the non-stationary element and the mating point along the path of the liner through the tensioning device or means.

13. The apparatus of claim 1 wherein the non-stationary and stationary elements are rollers.

14. The apparatus of claim 1 wherein the fixed end of the dancer element or reciprocating armature device includes an axel or a rotating or pivoting hub which is directly acted upon by the biasing means.

15. The apparatus of claim 1 wherein the reciprocating armature device includes a reciprocating armature, a biasing arm, and an axel or hub, the fixed end of the reciprocating armature and one end of the biasing arm attached to the axel or hub and wherein the biasing means acts upon the biasing arm.

16. The apparatus of claim 1 further comprising a roller element which serves as the mating point.

17. The apparatus of claim 16 wherein the mating point roller element is a double grooved roller.

18. The apparatus of claim 1 wherein the apparatus is adapted to wind a stock material that is flowable and/or manifests adhesive, tacky or sticky properties.

19. The apparatus of claim 18 wherein the stock material is a prepreg material.

20. The apparatus of claim 7 wherein the motor associated with the liner supply is a passive motor which does not impact the rate at which the liner is fed or drawn from the liner supply except when activated in response to the detector or sensor elements or means.

21. The apparatus of claim 7 wherein the motor associated with the liner supply acts upon an axel upon which the liner material is mounted.

22. The apparatus of claim 21 wherein the axel has a minor drag or resistance associated therewith to prevent free rotation of the axel.

23. The apparatus of claim 21 wherein the motor associated with the liner supply is passive and imparts no rotation to the axel until triggered by the detector or sensor elements or means.

24. The apparatus of claim 7 where a second detector or sensor element or means is present, said second detector or sensor element or means detecting at least one of 1) movement of the dancer element or reciprocating tensioning armature device and, hence, movement of the non-stationary element along the aforementioned path, 2) changes in the tension of the liner material and/or 3) differences in the rate at which the liner material is being fed or drawn from a the liner supply and the rate at which it is being taken up in the winding process and, in response thereto, stops the acceleration in the rate at which the liner material is fed or drawn from the liner supply.

25. The apparatus of claim 1 wherein the feed or draw of the liner material is effected by the winding, and spooling operation and does not involve any motors associated with the liner supply until triggered by the detector or sensor elements of means.

* * * * *